United States Patent [19]

Baskett

[11] Patent Number: 4,514,933

[45] Date of Patent: May 7, 1985

[54] SELF-BALANCED SURFACE-PROCESSING APPARATUS

[76] Inventor: Theodore N. Baskett, 9514 Portland Ave., Tacoma, Wash. 98441

[21] Appl. No.: 410,335

[22] Filed: Aug. 23, 1982

[51] Int. Cl.[3] ..... B24B 17/00

[52] U.S. Cl. ..... 51/32; 51/47; 51/99; 51/100 R; 51/241 S; 114/222; 118/305; 134/123; 15/21 E; 427/421

[58] Field of Search ..... 51/35, 32, 45, 46, 47, 51/99, 100 R, 429, 241 S; 114/222; 134/123; 118/305, 307, 323; 427/421; 15/21

[56] References Cited

U.S. PATENT DOCUMENTS

| | | | |
|---|---|---|---|
| 2,506,076 | 5/1950 | Garrison | 125/14 |
| 3,081,581 | 3/1963 | Hensley | 51/99 |
| 3,156,072 | 11/1964 | Boehme | 51/35 |
| 3,439,372 | 4/1969 | Collier | 15/21 |
| 3,562,959 | 2/1971 | Dooley | 51/47 |
| 3,589,072 | 6/1971 | Burt | 51/45 |
| 3,665,647 | 5/1972 | Weatherell | 51/45 |
| 3,667,166 | 6/1972 | White | 51/47 |
| 3,709,096 | 1/1973 | Stender-Robertz | 90/15 |
| 4,107,880 | 8/1978 | Randall | 51/103 |
| 4,248,019 | 2/1981 | Hawley | 51/45 |
| 4,305,344 | 12/1981 | Baskett | 118/305 |

*Primary Examiner*—Harold D. Whitehead
*Attorney, Agent, or Firm*—Eugene D. Farley

[57] ABSTRACT

A self-balanced surface-processing apparatus includes a tool support movable along a strip of airplane body or other work surface, in spaced relation thereto a pivot arm mounted on the tool support and mounting a sander, or other surface-processing tool on one end and a balancing counterweight on the other end. A biasing means engages the pivot arm and biases the surface-processing tool against the work surface at a preselected pressure. The apparatus is operable to traverse various irregular surfaces while maintaining constant contact pressure of the surface-processing tool.

7 Claims, 5 Drawing Figures

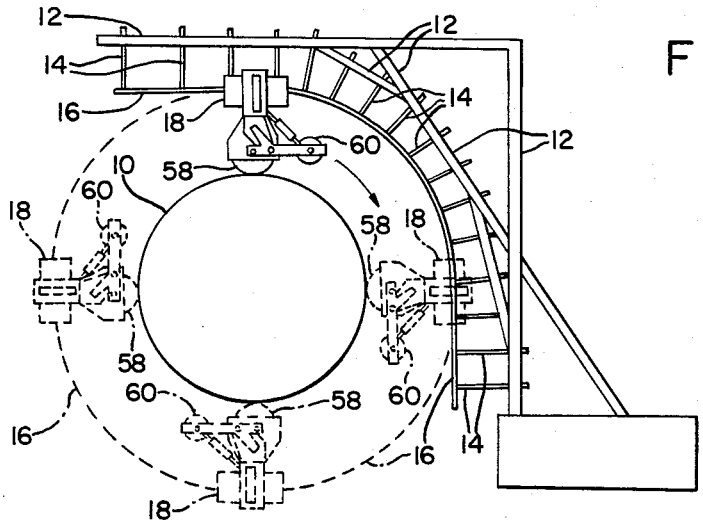
FIG. 1
FIG. 2
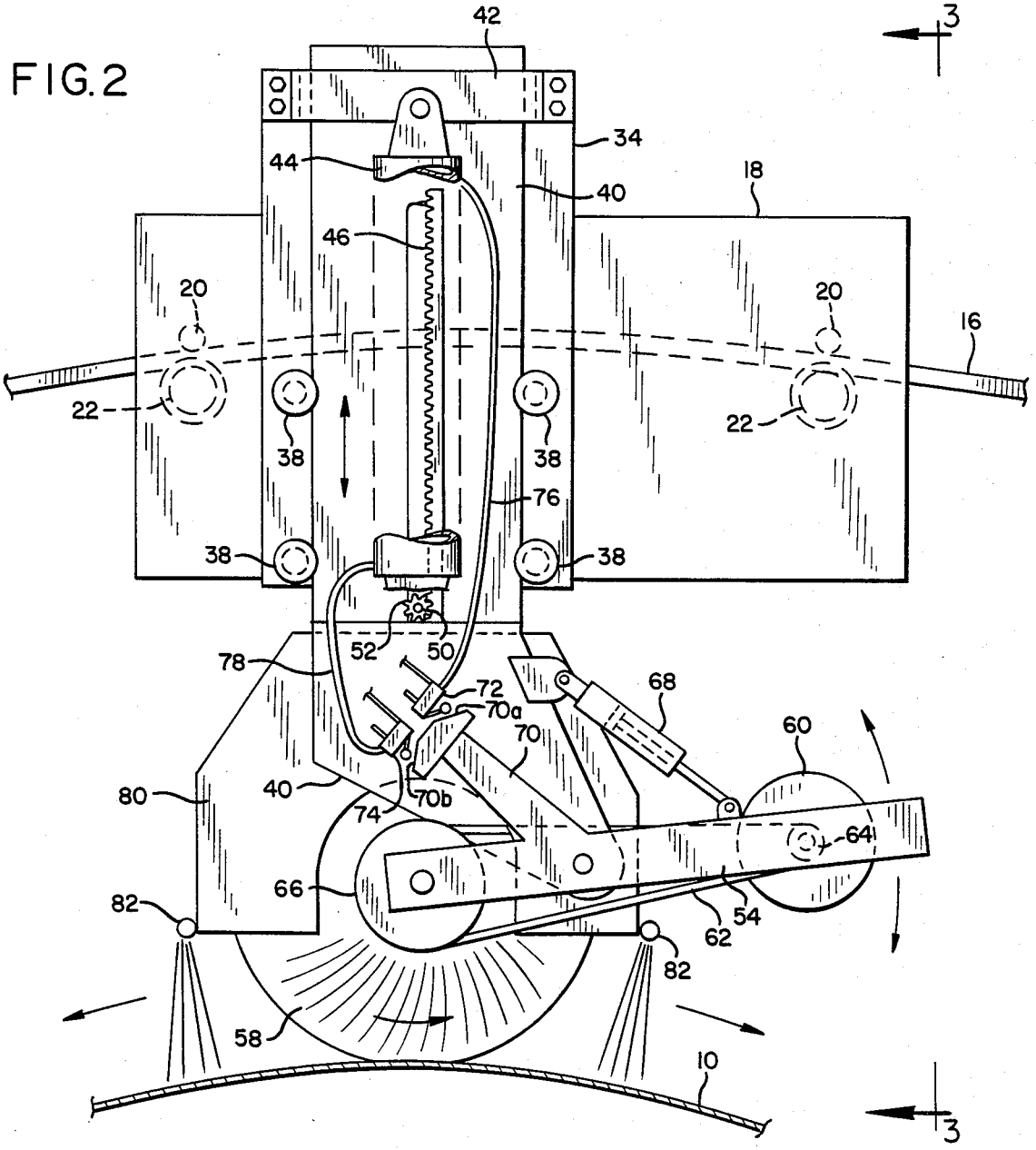

SELF-BALANCED SURFACE-PROCESSING APPARATUS

BACKGROUND OF THE INVENTION

This invention relates to surface-processing apparatus, and more particularly to a self-balanced apparatus wherein a surface-processing toll engages the surface to be processed at a preselected uniform pressure, regardless of surface irregularities, or the orientation of the surface-processing apparatus to the work surface.

My prior patent, U.S. Pat. No. 4,305,344 discloses a surface-processing apparatus including an elongated, pliant track which is curved to conform to the general contour of an aircraft fuselage or other surface to be processed. A carriage reciprocates along the track and mounts a surface-processing tool, which may be a painting or sanding apparatus, or the like.

In working on a sensitive-to-damage surface such as an aircraft fuselage, it is very desirable that the surface-processing tool engage the surface at a very exact preselected pressure. Further, the tool should be moved along the surface at a substantially constant rate. This is to insure that the proper amount of processing is achieved, uniformly over the surface, without damaging the sensitive surface.

It is also desirable that the track or other support means for the surface-processing tool be entirely separate from the surface itself. The processing operations require a delicate and controlled touch, and consequently nothing which may distort the work surface may be allowed to contact it. Since this precludes the use of external sensors which touch the workpiece, the track and surface-processing tool must be capable of positioning independently of such devices.

The prior art discloses surface-processing apparatus for work on slabs or rods which may have irregular contours. In such apparatus, the rods or slabs are passed through the apparatus, which accordingly is not applicable to the surface processing of large work pieces such as aircraft bodies and ship hulls, where the apparatus must be passed over the surface of the work.

Further, in the latter application the orientation of the surface-processing tool is continuously changing, which introduces further and unique problems.

Accordingly, it is the general object of the present invention to provide a high capacity surface-processing apparatus which traverses and engages an irregular work surface with a constant, preselected pressure.

Another object is to provide such an apparatus which is balanced to work equally well in all orientations.

Yet another object is to provide means for establishing accurately the position of a track supporting a surface-processing tool, relative to the surface to be processed.

Another object is to provide a carriage for traversing the track and carrying the surface-processing tool along a work surface strip of predetermined extent.

A further object is to provide extension means for accomodating any large-scale variation at different points in the distance between the tool-supporting track, and the adjacent work surface.

Yet another object is to provide sensitive apparatus which quickly and positively compensates for minor or suddenly-encountered irregularities in the contour of the work surface.

A further object is to provide an apparatus adjustable to have a very delicate and controlled touch for processing surfaces which previously could be worked on only by hand.

A still further object is to provide a surface-processing apparatus in which the surface-processing tool is its own sensor of proximity to the work surface.

These and other objects and advantages of the present invention and the manner in which they are achieved will be made apparent in the following specification and claims.

SUMMARY OF THE INVENTION

In its general concept, the present invention is a self-balanced surface-processing apparatus including a tool support movable along a strip of work surface. A pivot arm is carried by the tool support. It mounts a surface-processing tool on one end and a counterweight on the other end. A biasing means engages the pivot arm and biases the surface-processing tool against the work surface at a preselected, uniform pressure.

BRIEF DESCRIPTION OF THE DRAWINGS

FIG. 1 is a side elevation of the surface-processing apparatus of the present invention, illustrating the framework, track, and the surface-processing tool applied to the work surface in a plurality of orientations.

FIG. 2 is a side elevation of the surface-processing apparatus, similar to FIG. 1 but much enlarged.

DESCRIPTION OF THE PREFERRED EMBODIMENT

As shown in FIG. 1, the self-balanced surface-processing apparatus of the present invention is arranged to work on a surface 10 which may be an aircraft fuselage, ship hull or the like.

A frame 12 includes frame members roughly conforming in contour to the work surface to be processed. A plurality of track-mounting members 14, which may be sonar-controlled, fluid-operated cylinders, are hinged both to the frame and to a resiliently pliable track 16. The track-mounting members are adjustable for conforming the track to a predetermined shape, preferably paralleling the work surface as closely as possible.

Track 16 is spaced apart from surface 10 within a range of distance determined by the construction dimensions of the surface-processing apparatus. The limits of the spacing will become apparent hereinafter.

As FIG. 1 illustrates, it is necessary to approach work surface 10 from various angles, and the frame and track assembly shown may either be moved to other configurations, or a plurality of such devices may be provided as desired to accommodate the particular application.

Figure 3:
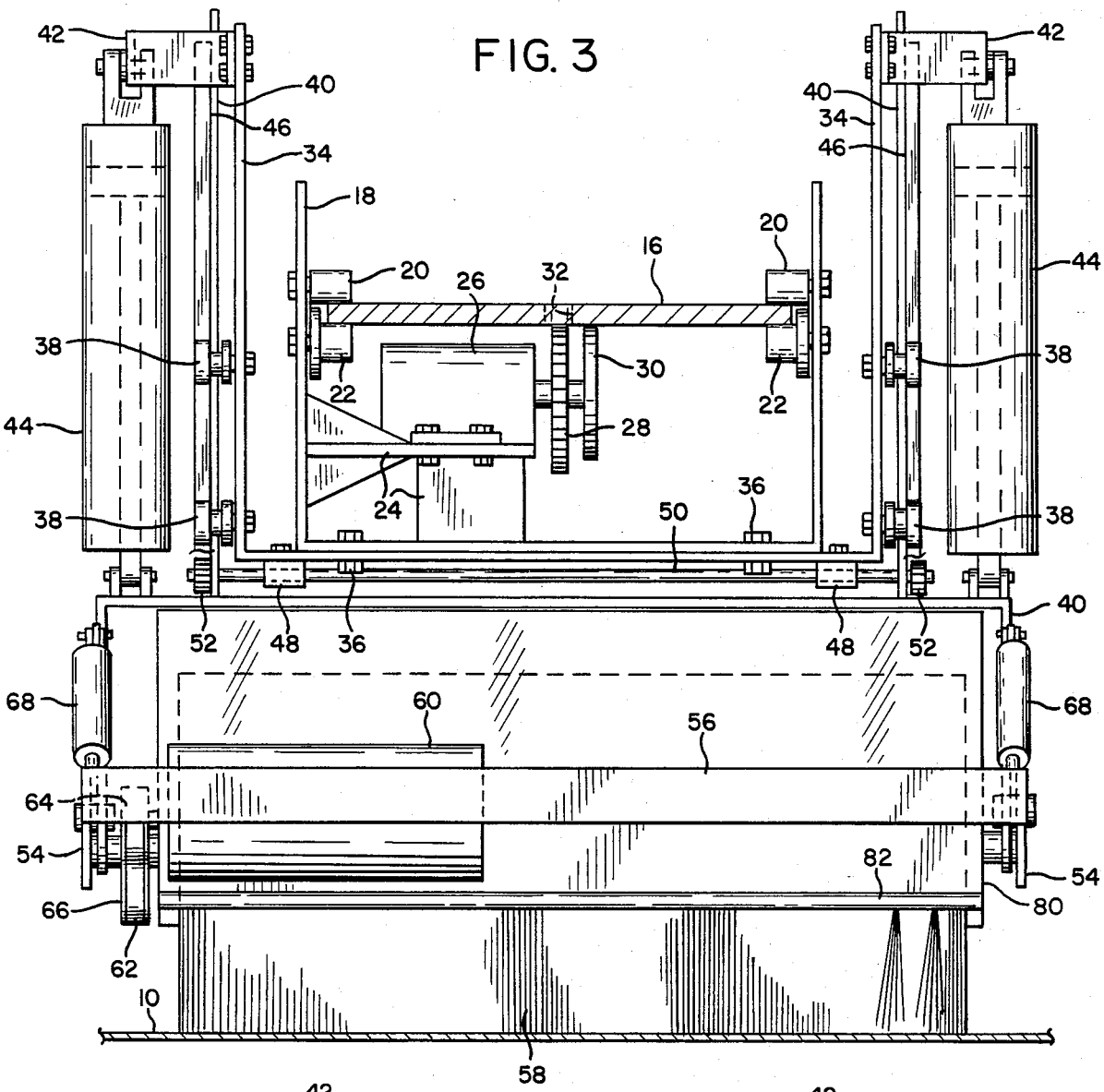
FIG. 3 is a front elevation of the apparatus of FIG. 2, looking in the direction of lines 3—3 of FIG. 2.

FIGS. 2 and 3 illustrate in further detail the surface-processing apparatus.

Track 16 mounts a carriage 18 which reciprocates along the track. The carriage is mounted on the track by top and bottom guide rollers 20 and 22, respectively. A mounting bracket 24 mounts carriage motor 26. The motor drives reversibly sprocket wheel 28 and support wheel 30. The sprocket wheel engages holes 32 in the track and thus reciprocates the carriage along the track.

The foregoing general assembly is described in more detail in my previous patent, U.S. Pat. No. 4,305,344. However, in the presently described improved assembly, the carriage is mounted with its working elements on the bottom or outside of the track, thus allowing track mounting members 14 to attach to the top or inside of the track. This is possible since the surface of the track is no longer intended to contact work surface 10.

A mounting frame 34 is secured to the carriage by bolts 36. The mounting frame mounts extension rollers 38 which confine and guide a reciprocatable tool support 40 in a direction substantially perpendicular to the track.

Frame 34 mounts brackets 42 which in turn support cylinders 44 between the frame, which is attached solidly to carriage 18, and the movable tool support. The cylinders provide extension means operable to vary the distance between the carriage and the tool support over the range of travel of the tool support in rollers 38.

As can be seen in FIG. 3, each side of the apparatus is similar to the other, which facilitates even loading and improves stability.

In addition to cylinders 44 the extension means includes a rack and pinion system to insure equal extension of both cylinders 44.

A rack 46 is attached to tool support 40 on each side of the apparatus. Frame 34 mounts bearings 48 which journal a rotating shaft 50. A pinion 52 is fixed on each end of the shaft. Each pinion engages a rack 46. Accordingly, one side of the apparatus cannot move without the other side also moving. This is a backup and stabilization to cylinders 44, which are plumbed in parallel in any case.

As best shown in FIG. 2, tool support 40 pivotally mounts a pivot arm 54. Preferably two similar pivot arms are provided, mounted on the same pivotal axis and connected by cross-brace 56 (FIG. 3).

A surface-processing tool such as sanding drum 58 is mounted rotatably on one end of the pivot arms. The sanding drum is mounted in a position such that the axis of extension of the extension means is centered thereon. This requires the angled bend of the tool support shown in FIG. 2.

A counterweight is mounted on the other end of the pivot arms to balance the surface-processing tool. Preferably, the counterweight comprises a motor 60 which drives sanding drum 58 via a belt 62 between pulleys 64 and 66. Of course, the counterweight may include mass other than the motor, and the motor may be positioned at a greater or lesser distance on the pivot arms as desired in order to balance the assembly at the mounting point of the pivot arms.

A biasing means is provided for biasing the surface processing tool against the work surface at a preselected pressure.

Preferably, such means includes an expansible cylinder 68 mounted between tool support 40 and pivot arm 54. The cylinder is biased with a pressure difference which remains substantially constant throughout its range of extension. The pressure is adjustable from a very light pressure to a very great pressure, depending on the desired amount of contact of the surface-processing tool against the work surface. It is important to note that the pressure applied to the work surface is constant in all orientations of the device, and remains constant even if irregularities in the work surface are traversed.

Extension control means is provided for controlling the extension of cylinders 44.

Such means includes a cam arm 70 attached to pivot arm 54 and extending adjacent to tool support 40. The arm has a head with sloped, switch-actuating surfaces **70*a* and 70*b*. These engage and operate switches 72 and 74 to which bleed hoses 76 and 78 are attached to bleed pressure from the top or bottom of cylinder 44, respectively. Accordingly, a change in the angle of the pivot arm causes the cam arm to engage one of the switches, and fluid from one side of cylinder 44** is bled faster than it can be replaced. This causes a movement of the extension means which is in a direction to counter the pivotal movement of the pivot arm.

A shield 80 is attached to tool support 40 and surrounds sanding drum 58. Sufficient clearance is allowed to accommodate the rocking motion of the pivot arm and the resultant motion of the sanding drum.

Air jets 82 are attached to the shield for directing streams of cleaning air onto the work surface. In the alternative, if desired, the jets may direct some other fluid onto the surface, for instance a cleaning solution, or an abrasive suspension.

OPERATION

The manner of operation of the presently described surface-processing apparatus can best be explained with reference to FIGS. 4 and 5.

Figure 4:
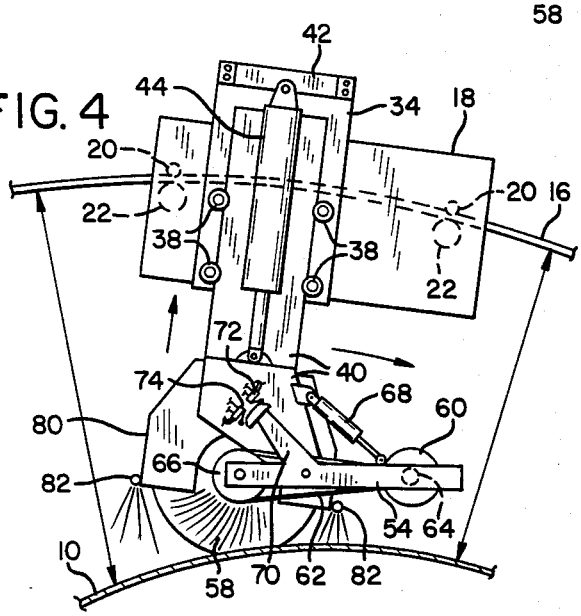
FIGS. 4 and 5 are side elevations of the surface-processing apparatus illustrating the respective handling of large scale and small scale variation in the contour of the work surface.

In FIG. 4 the apparatus is illustrated moving forwardly along track 16 in the direction of the arrow. Track 16 is shown as not parallel with surface 10 and consequently the distance between the track and the surface is constantly decreasing.

As the apparatus moves, sanding drum 58 is pivoted slightly upwardly. Arm 70 actuates switch 72, which causes pressure to be released from the top of cylinders 44. The resulting pressure differential causes tool support 40 to retract.

The reverse events would occur were the apparatus traveling in the opposite direction. Thus the surface processing tool's pressure is maintained constant on the work surface.

Figure 5:
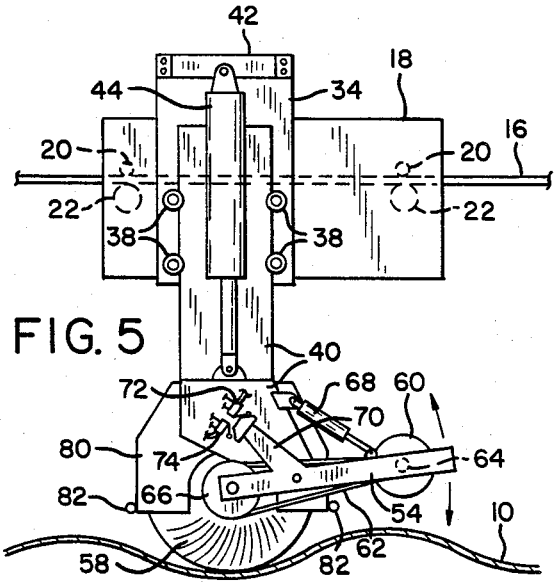

In FIG. 5 the work surface 10 is shown undulating with respect to track 16. Movement across the surface causes sanding drum 58 to move up and down. Its pressure on the surface remains constant, however, since the biasing pressure in cylinder 68 is constant regardless of position. Of course, arm 70 would engage switches 72 and 74, and this would cause a movement of the extension means. But depending on the speed of travel along track 16, cylinder 44 would not have time to completely adjust.

Accordingly, within a range, the rocking motion of pivot arm 54 is adequate to compensate for surface irregularities. The pivot arm instantaneously takes the initial variation in surface contour, while the extension means accommodates variations of greater magnitude.

It will be appreciated that those skilled in the art could make many changes or modifications of the presently described device without departing from the spirit and scope of the invention. For instance, any surface processing tool which needs to contact the surface at a substantially constant pressure could be used in place of sanding drum 58. Any means for bringing the tool support into a position for allowing the surface processing tool to traverse the surface would simply be an obvious modification of the presently described track and carriage assembly. Also, various fluid controls are discussed herein, but other feedback systems could likewise be employed.

Having described my invention in its preferred embodiment, I claim:

1. A surface processing apparatus, comprising:
(a) a frame,
(b) a track mounted on the frame a spaced distance from the surface to be processed,
(c) a carriage on the track movable along the latter,
(d) a tool support,
(e) a surface processing tool mounted on the tool support,
(f) powered extension means directly interconnecting the carriage and the tool support and operable to move the latter to move the processing tool toward and away from a surface to be processed,
(g) extension control means for controlling movement of the extension means, and
(h) sensor means operatively associated with the extension control means and tool support and operable upon changing of the distance between the track and surface to be processed to operate the extension means to move the tool support in the direction to maintain substantially constant surface contacting pressure of the processing tool against the surface to be processed.

2. A surface processing apparatus, comprising:
(a) a frame,
(b) a track mounted on the frame a spaced distance from the surface to be processed,
(c) a carriage on the track movable along the latter,
(d) a tool support member mounted on the carriage for movement in a direction substantially perpendicular to the direction of movement of the carriage,
(e) a surface processing tool,
(f) a pivot arm mounted on the tool support member and supporting the processing tool for movement toward and away from a surface to be processed,
(g) biasing means interengaging the tool support member and pivot arm for biasing the surface processing tool against the work surface at a preselected pressure,
(h) extension means supported by the carriage and mounting the tool support member for movement therewith and operable to move the latter to move the processing tool toward and away from a surface to be processed,
(i) extension control means for controlling movement of the extension means, and
(j) sensor means operatively associated with the extension control means and tool support member and operable upon changing of the distance between the track and surface to be processed to sense the pivotal movement of the pivot arm relative to the tool support member to operate the extension meas to move the tool support member in the direction to maintain substantially constant surface contacting pressure of the processing tool against the surface to be processed.

3. The apparatus of claim 2 wherein the extension means is arranged with the longitudinal axis of extension centered on the surface processing tool.

4. The apparatus of claim 2 including counterweight means mounted on the pivot arm to balance the surface processing tool.

5. The apparatus of claim 2 wherein the surface processing tool is a rotatable sanding drum, and motor means for driving the sanding drum is mounted on the pivot arm as a counterweight.

6. The apparatus of claim 2 wherein the biasing means comprises a fluid operated cylinder mounted between the support member and the pivot arm and arranged to maintain substantially constant pressure therein.

7. The apparatus of claim 2 wherein the extension means comprises a fluid operated cylinder and wherein the extension control means comprises a fluid circuit including control valve means, and the sensor means comprises a valve operating cam arm extending from the pivot arm and arranged for contacting and operating the control valve means upon movement of the pivot arm to move the extension means in the direction to move the surface processing tool to maintain substantially constant pressure contact with the surface being processed.

* * * * *